US006705974B1

(12) United States Patent
Tardif

(10) Patent No.: US 6,705,974 B1
(45) Date of Patent: Mar. 16, 2004

(54) ATHLETIC STRETCHING DEVICE

(76) Inventor: Mario J. Tardif, 8108 NW. 75th Ave., Tamarac, FL (US) 33321

( * ) Notice: Subject to any disclaimer, the term of this patent is extended or adjusted under 35 U.S.C. 154(b) by 172 days.

(21) Appl. No.: 10/086,314

(22) Filed: Mar. 1, 2002

(51) Int. Cl.[7] ..... A63B 71/00
(52) U.S. Cl. ..... 482/39; 482/40; 482/148; 482/907
(58) Field of Search ..... 482/37, 39, 40, 482/43, 148, 907, 908, 49

(56) References Cited

U.S. PATENT DOCUMENTS 5,048,825 A 9/1991 Kelly
5,181,289 A 1/1993 Kassai
5,261,865 A 11/1993 Trainor
5,288,283 A 2/1994 Meeker
5,407,411 A 4/1995 Trainor
5,429,571 A 7/1995 Smith
5,595,559 A 1/1997 Viel
5,634,873 A 6/1997 Carlstrom
5,947,875 A 9/1999 Cone

*Primary Examiner*—Nicholas D. Lucchesi
*Assistant Examiner*—L Amerson
(74) *Attorney, Agent, or Firm*—Malin, Haley & DiMaggio, P.A.

(57) ABSTRACT

A stretching device for stretching and strengthening the muscles of the lower back and legs of the user. The stretching device generally includes an attachment bracket, pull cord and pulley. The attachment bracket attaches to the top of a door frame and the pull cord and pulley are attached to the attachment bracket. The pull cord engages the pulley so that a sling is formed on one side of the pulley. A user inserts their leg into the sling and raises and lowers the sling causing muscles in the legs and back to stretch. Several stretching routines are possible which isolate and target certain muscle groups.

9 Claims, 10 Drawing Sheets

ATHLETIC STRETCHING DEVICE

BACKGROUND OF THE INVENTION

1. Field of the Invention

This invention relates generally to exercise stretching devices and more specifically to portable exercise stretching devices.

2. Description of Related Art

Exercise routines involve stretching to maintain flexibility as well as prepare muscles for action. Traditionally, before executing an exercise routine such as lifting weights the muscles are stretched to avoid cramping and prepare the muscle for load. Additionally, stretching serves to increase and maintain flexibility in the joints and is an important tool in physical therapy when a person is recovering from an accident.

Current stretching equipment is complex. Even relatively simple devices designed to stretch the muscles include numerous parts and require intricate assembly or installation. One such device is described in U.S. Pat. No. 5,634,873 issued to Carlstrom. This exercise device includes a stretching line that is routed through a device that attaches to a door using a complex specially made anchor bracket having a threaded shaft and a plate. The proprietary anchor bracket makes ,the stretching device in Carlstrom relatively complex and expensive to manufacture. Another such stretching device is described in U.S. Pat. No. 5,261,865 issued to Trainor. The stretching device in Trainor describes a backboard which supports a post section, a cable and a pulley which are assembled to create a device that a user lies upon and is strapped into. The backboard and post section make the stretching device in Trainor bulky and difficult to transport and store.

What is needed is a simple exercise stretching device that is constructed from few components that require little assembly that is easy and inexpensive to manufacture and produce.

BRIEF SUMMARY OF THE INVENTION

An exercise stretching device constructed from a single pull cord, a pulley and an attachment bracket constructed from a rigid material.

The pull cord is constructed from nylon rope having first and second ends. The first end of the pull cord is folded and clamped together so that a loop is formed. A small one wheel pulley is attached to the loop. The pulley is adapted in size to receive the pull cord.

The first end of the pull cord is suspended from the attachment bracket. The attachment bracket is constructed from a u-shaped rigid member with integral diametrically opposed flattened fingers at either end. The flattened fingers are formed by flattening and bending the ends of the u-shaped member used to construct the attachment bracket. The attachment bracket is installed on a door frame by pulling the u-shaped member slightly apart thereby spreading the distance between the fingers, positioning the u-shaped member so that the fingers are located above the door frame and then squeezing the u-shaped member together so that the fingers close and suspend the attachment bracket from the door frame. When the attachment bracket is properly installed the fingers rest on top of the door frame so that the attachment bracket hangs from the door frame. The first end of the pull cord is installed upon the attachment bracket by passing the loop through the bracket before installation on the door frame so that the loop, pulley and remaining length of rope hang down from the u-shaped member.

The second end of the pull cord is threaded through the suspended pulley creating a sling. The height of the sling is controlled by pulling the second end of the pull cord. The sling may be padded by foam or sponge padding.

In use, a user places their leg in the sling so that the sling supports the ankle of the leg and pulls the second end of the pull cord causing the sling to rise and consequently the leg inserted into the sling to rise and stretch. Several different muscle groups may be stretched, depending upon how the user stands and uses the stretcher.

Accordingly, it is an object of the present invention to provide a stretching device that is easy to use, simple to assemble with few parts, useful for a variety of stretches, and easily transportable.

Yet another object of the present invention is to provide a stretching device which is inexpensive to produce and manufacture.

Still another object of the present invention is to provide a stretching device that will fit over any standard thickness wall.

In accordance with these and other objects which will become apparent hereinafter, the instant invention will now be described with particular reference to the accompanying drawings.

DETAILED DESCRIPTION OF THE INVENTION

Figure 1:
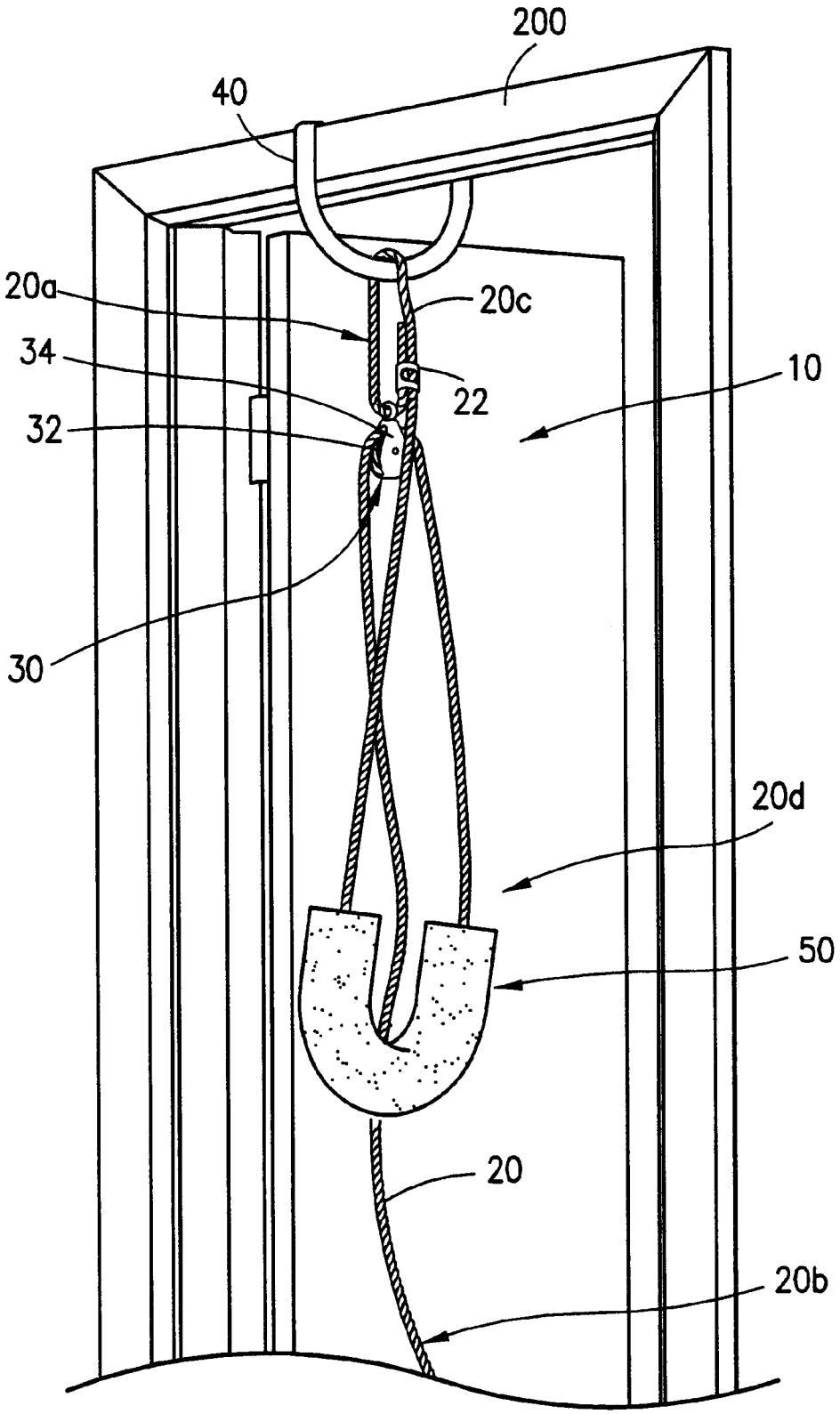
FIG. 1 is a perspective view of the preferred embodiment of the invention.

Referring now to FIG. 1 there is seen the exercise stretching device 10 installed. Exercise stretching device 10 is constructed from a pull cord 20, a pulley 30 and an attachment bracket 40.

Pull cord 20 is constructed from sturdy material such as nylon and is approximately one-half inch diameter having first and second ends 20*a* and 20*b*. Nylon rope is preferred for it's low elasticity and resistance to staining, mildew, abrasion or rot. Nylon rope is also easily gripped. Alternatively, pull cord 20 may also be constructed from cotton, polypropylene, plastic coated wire or other suitable material. First end 20*a* of pull cord 20 is folded and clamped together using rope clamp 22 so that a loop 20*c* is formed. Pulley 30 is attached to attachment clamp 40 by loop 20*c*. Pulley 30 is adapted in size to receive pull cord 20 and preferably is a conventional type one-wheel pulley. Alternatively, pulley 30 may be a conventional multiple wheel pulley. Pulley 30 is formed by a wheel 32 rotatably mounted within a hang clamp 34. Loop 20*c* passes through a hole in hang clamp 34 so that pulley 30 is attached to loop 20*c*.

Figure 2:
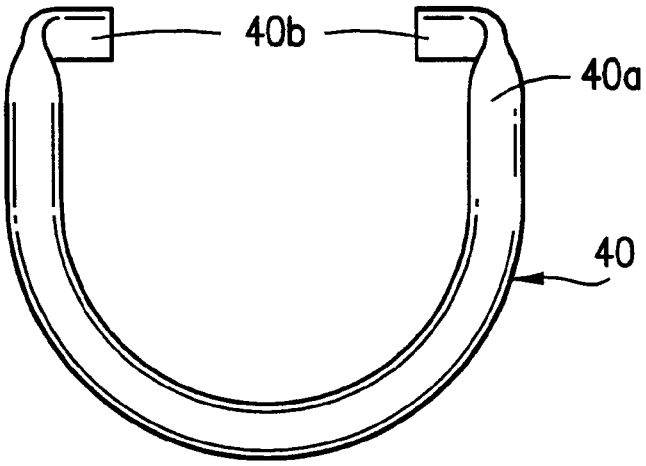
FIG. 2 is a side view of the preferred attachment bracket of the invention.

First end 20*a* of pull cord 20 hangs from attachment bracket 40 as seen in FIGS. 1–2, 4–11, and 13–18. Attachment bracket 40 comprises a u-shaped member 40*a* with integral flat fingers 40*b* at either end, as seen in FIG. 2. U-shaped member 40*a* is preferably formed by heating a length of electrical PVC pipe and bending it so that it resembles a 'U'. Fingers 40*b* are formed by flattening and bending the ends of the u-shaped member 40*a*. Other materials such as plastic may be used. Fingers 40*b* are diametrically opposed and form a plane perpendicular with the plane created by u-shaped member 40*a* as see in FIG. 2. Attachment bracket 40 is preferably installed on a door frame 200 by pulling fingers 40*b* slightly apart thereby spreading the distance between fingers 40*b*, positioning the bracket 40 so that fingers 40*b* are located above door frame 200 and then squeezing together fingers 40*b* so that fingers 40*b* close and suspend bracket 40 from door frame 200. Other projectors, such as bulkheads, may alternatively be used. When bracket 40 is properly installed fingers 40*b* rest on top of door frame 200 so that bracket 40 hangs from door frame 200 as shown in FIGS. 1, 4–11 and 12–18. Preferably, the bracket may be of a pre-determined size so that it will fit over any standard thickness door frame. First end 20*a* of pull cord 20 is attached to attachment bracket 40 by passing loop 20*c* through bracket 40 before installation on door frame 200 so that loop 20*c* is linked with attachment bracket 40. When properly attached loop 20*c*, pulley 30 and the remaining length of pull cord 20 hang down from u-shaped bracket 40 as seen in FIG. 1.

Figure 3:
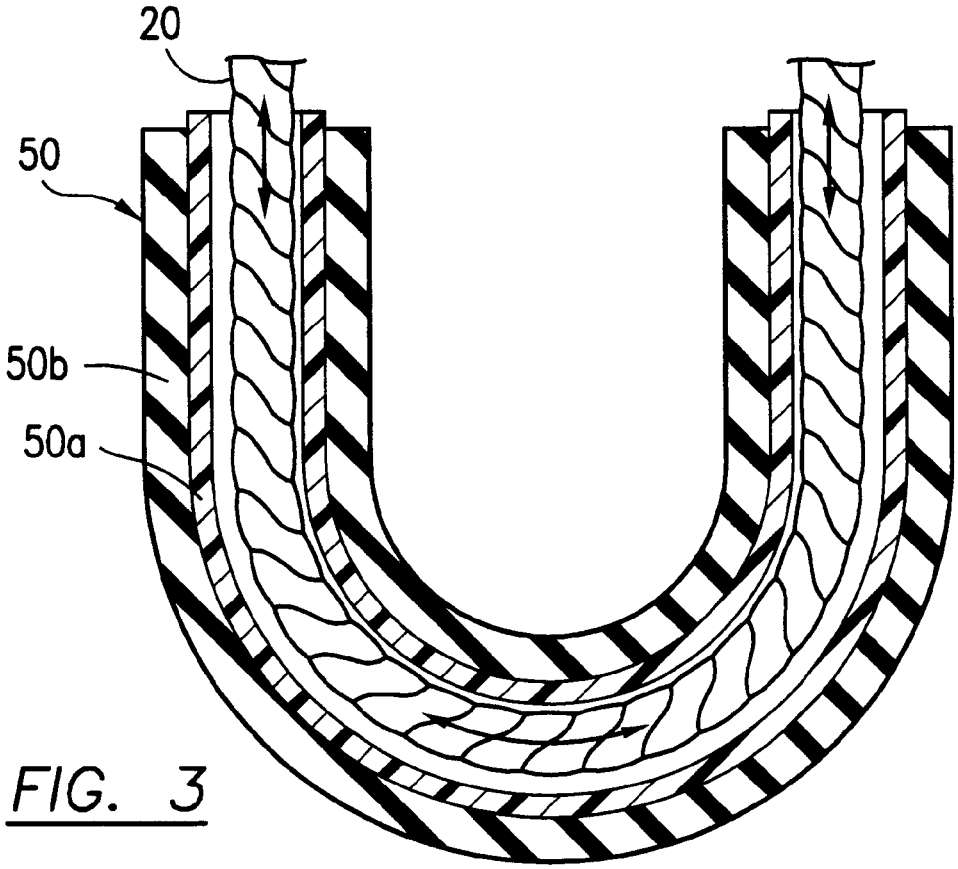
FIG. 3 is a cut away view of the sling support of the invention.

Second end 20*b* of pull cord 20 is threaded through suspended pulley 30 creating a sling 20*d*. The height of sling 20*d* is controlled by pulling second end 20*b* of pull cord 20. Alternatively, a slide sheave which allows the pull cord 20 to slide through easily may be used instead of pulley 30. Sling 20*d* is padded by sling support 50 as seen in FIGS. 1 and 3. Sling support 50 is preferably formed by a u-shaped sling tube 50*a* and foam padding 50*b* as shown in FIG. 3. Sling tube is preferably constructed from PVC pipe of approximately one inch diameter. Sling tube 50*a* is preferably formed by heating a length of PVC pipe and bending it so that it resembles a 'U' which is sized to accommodate the leg of a user. Foam padding 50*b* wraps around sling tube 50*a* so that sling tube 50*a* is surrounded and fully padded. Sling tube 50*a* allows pull cord 20 to slide within sling support 50 so that as sling 20*d* is raised pull cord 20 does not bind or stick causing the movement of sling support 50 to be irregular.

Figure 5:
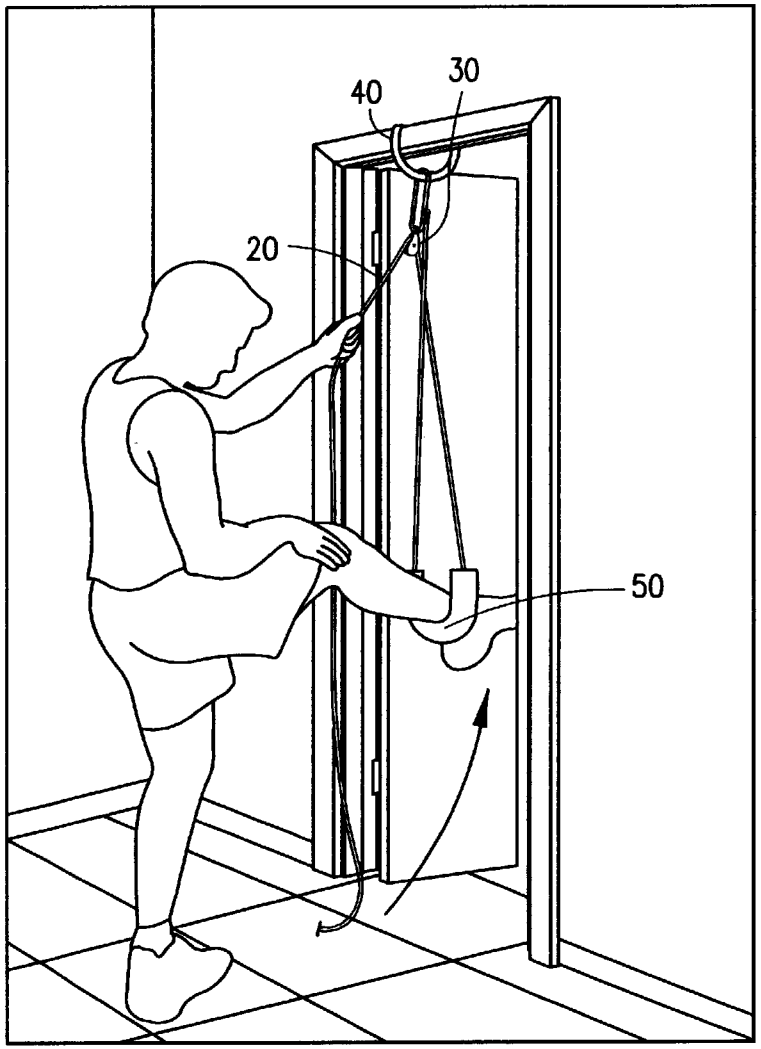
FIG. 5 is a perspective view of the invention in use as a user is in the initial stages of a leg stretch.
Figure 4:
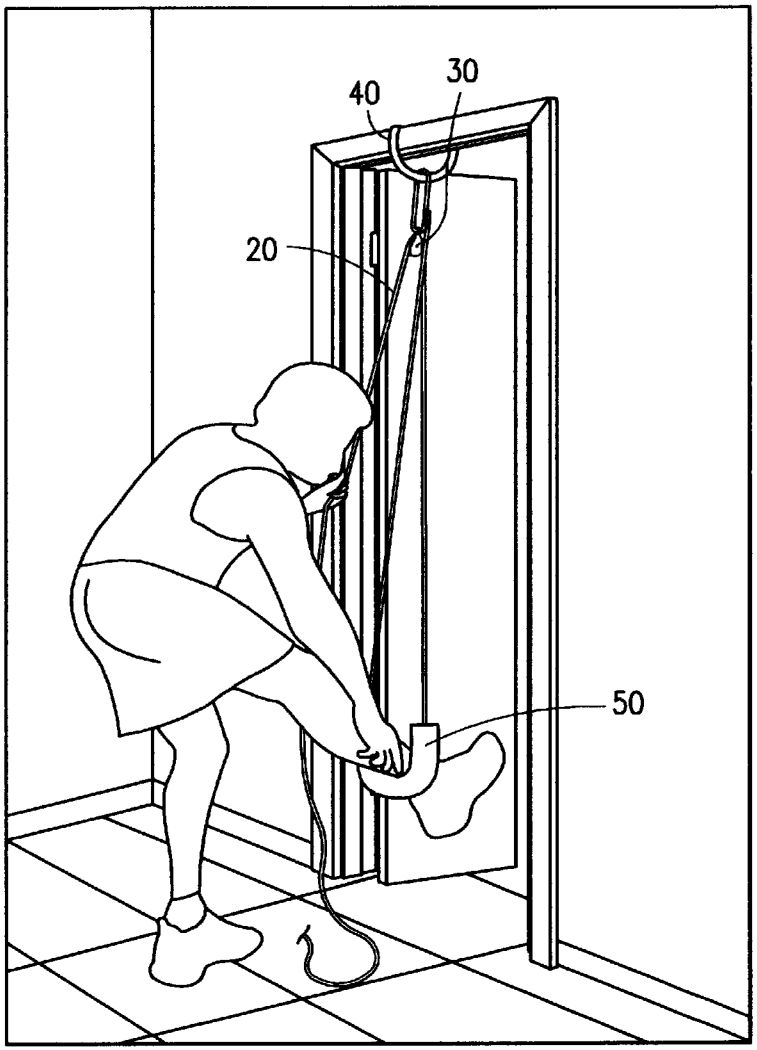
FIG. 4 is a perspective view of the invention in use as a user prepares to perform a leg stretch.

In use, a user can perform a number of different stretching routines. Generally a user places their leg in sling support 50 so that sling support 50 supports the ankle or foot of the user's leg. The sling support 50 may be lowered to the ground as shown in FIG. 4 for convenience and safety. Once the ankle is supported by sling support 50 the user can slowly pull the second end 20*b* of pull cord 20 causing sling support 50 to rise and consequently the leg inserted into sling support 50 to rise and stretch as shown in FIG. 5. A number of stretch routines can be accomplished using stretching device 10, several of which are described below.

Figure 7:
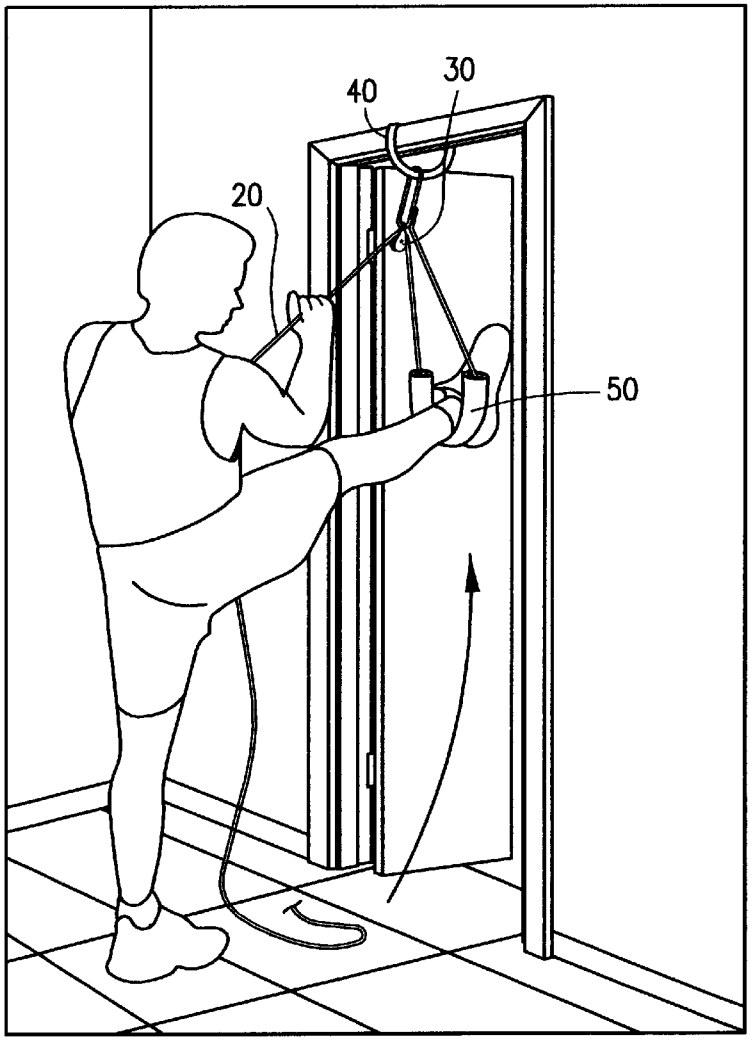
FIG. 7 is a perspective view of the invention in use as a user is performing a hamstring stretch.
Figure 6:
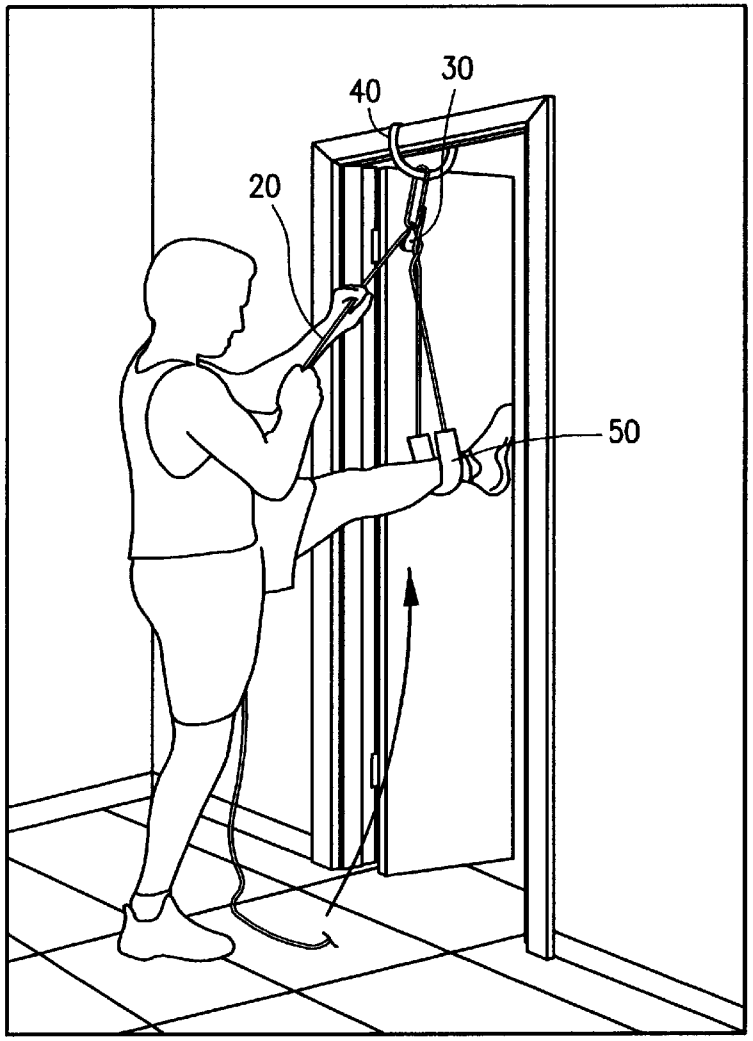
FIG. 6 is a perspective view of the invention in use as a user is in the initial stages of a hamstring stretch.

Referring to FIGS. 6 and 7, there is illustrated a hamstring stretch routine using stretching device 10. The hamstring muscles are located behind the thigh and are responsible for flexion of the knee joint. To target the hamstring muscles the user is positioned to stand adjacent to and facing the doorframe 200. The user places the right leg within sling support 50 so that the leg is supported by sling support 50 at the ankle. Sling support 50 may be lowered to the floor so that a user can safely and conveniently place a leg within sling support 50 without having to raise the leg. Once the leg is properly placed within sling support 50 the user begins the routine by slowly pulling pull cord 20 causing sling support 50 to rise and consequently the leg supported by sling support 50 to rise. Since the user is facing doorframe 200 and the leg is raised in front them, the hamstring of the raised leg is isolated and is caused to stretch while the leg continues to be raised. When the user feels that the limit of the stretch has been reached, the user stops pulling pull cord 20 and then slowly releases pull cord 20 so that the leg descends to the ground. The user can then repeat the routine with their left leg if desired as seen in FIG. 7.

Figure 9:
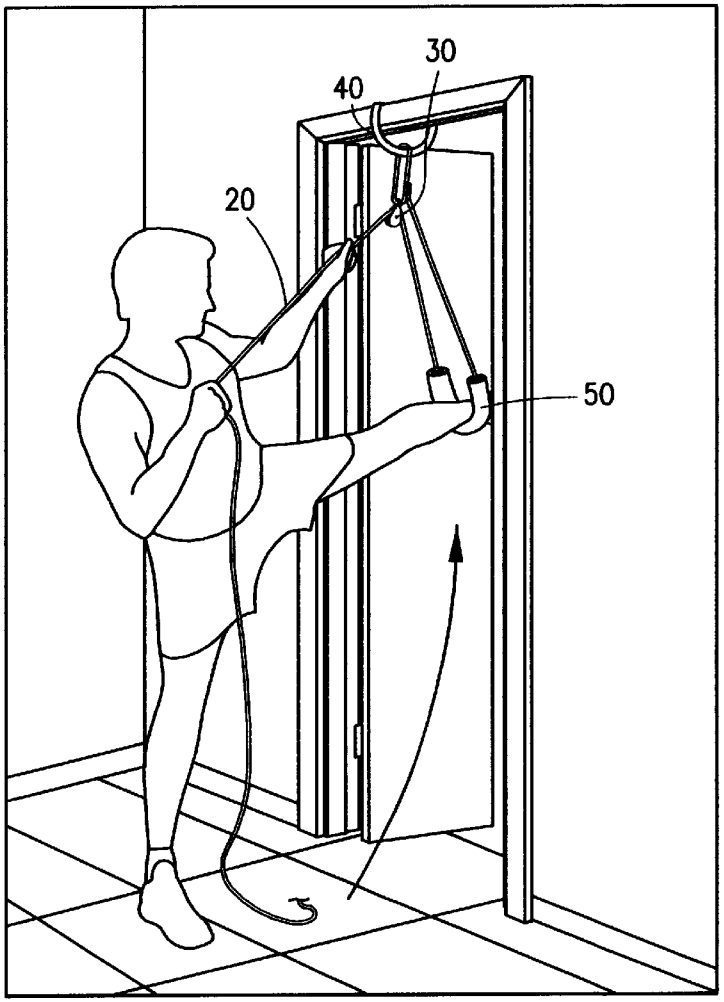
FIG. 9 is a perspective view of the invention in use as a user is performing a left thigh adductor stretch.
Figure 8:
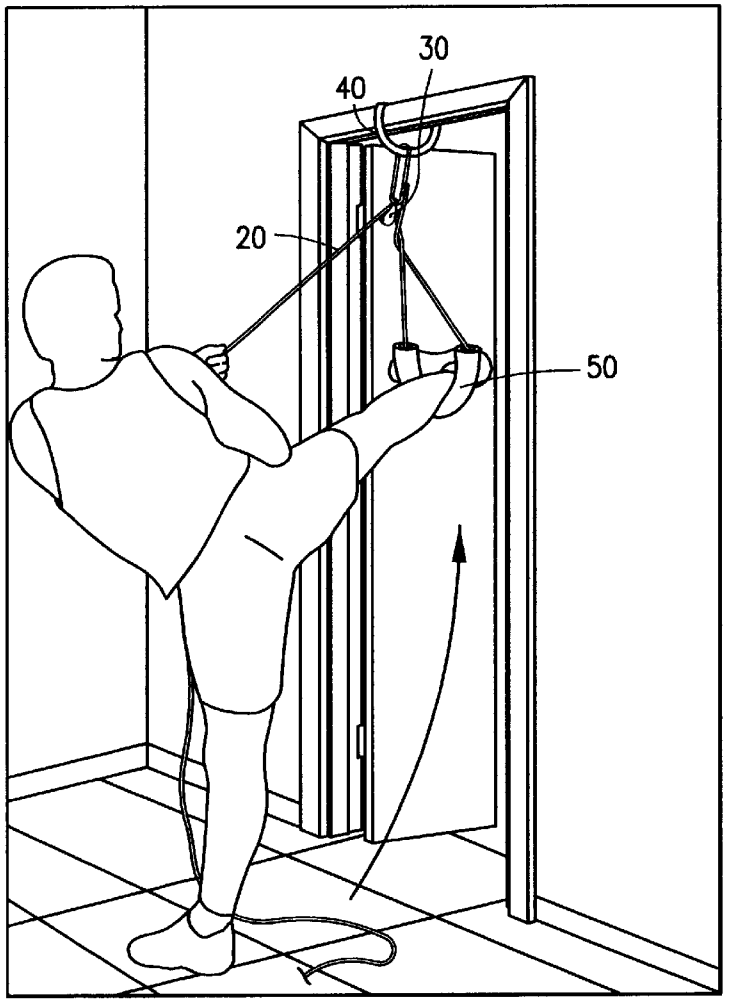
FIG. 8 is a perspective view of the invention in use as a user is performing a right thigh adductor stretch.

Referring to FIGS. 8 and 9, there is illustrated a thigh adductor stretch routine using stretching device 10. The thigh adductor muscles are located on the inside of the thigh and responsible for adduction of the hip joint. To target the adductor muscles the user first places the right leg within sling support 50, while standing adjacent to doorframe 200 so that the user is facing a direction that is perpendicular to the plane created by the doorframe 200. Pull cord 20 is adapted in length so that sling support 50 may be lowered to rest on the floor below doorway 200 so that a user can safely and conveniently place a leg within sling support 50 without having to raise their leg. When properly placed within sling support 50 the leg is supported substantially at the ankle. Once placed within sling support 50 the user begins the routine by slowly pulling pull cord 20 causing the leg to raise. Since they are perpendicular with the plane created by door frame 200 the adductor muscles inside the thighs of the leg are isolated and are caused to stretch while the leg is raised to the side of the user as seen in FIG. 8. When the user feels that the limit has been reached, the user stops pulling pull cord 20 and then slowly release pull cord 20 so that the leg descends to the ground. The user can then repeat the routine with the left leg as seen in FIG. 9.

Figure 11:
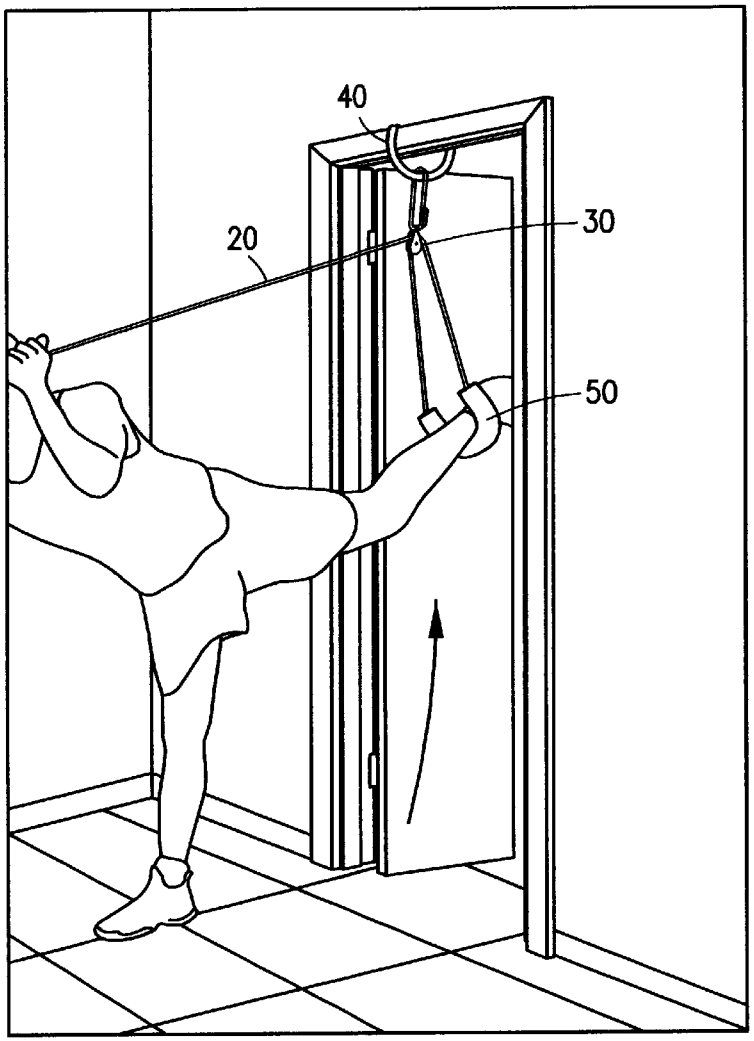
FIG. 11 is a perspective view of the invention in use as a user is performing a quadricep and back stretch.
Figure 10:
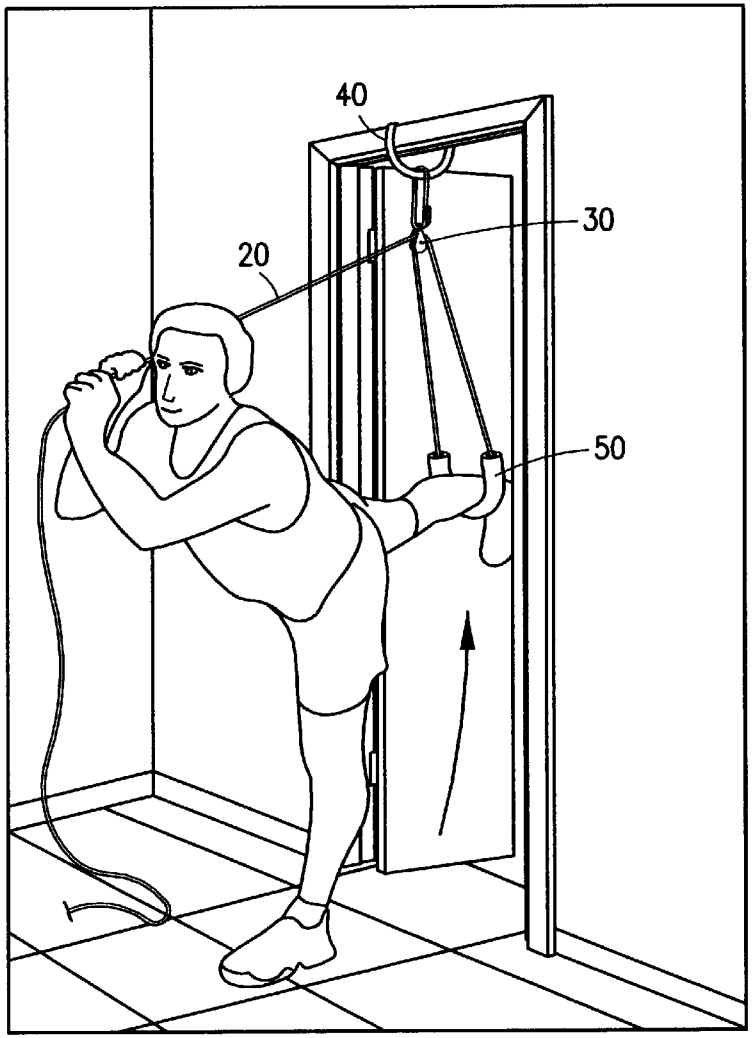
FIG. 10 is a perspective view of the invention in use as a user is in the initial stages of a quadricep and back stretch.

Referring to FIGS. 10 and 11, there is illustrated a quadriceps and back stretch routine using stretching device 10. The quadricep muscles are located on the front of the thigh and are responsible for extension of the knee joint. The back muscles are located opposite the abdominal muscles and serve to support the body and the back. To target the quadriceps the user first places a leg within sling support 50 while standing adjacent to and facing away from doorframe 200. Pull cord 20 is adapted in length so that sling support 50 may rest on the floor below doorway 200 so that a user can safely and conveniently place a leg within sling support 50 without having to raise the leg substantially. When properly placed within sling support 50 the leg is supported substantially at the ankle or top of the foot. Once placed within sling support 50 the user begins the routine by leaning forward and slowly pulling pull cord 20 causing sling support 50 to rise and consequently the leg supported by sling support 50 to rise. Since they are facing away from door frame 200 the quadriceps at the front of the thigh are isolated and are caused to stretch while the leg is raised behind the user. As the user leans forward the back muscles are also targeted and caused to contract. When the user feels that the limit has been reached, the user stops pulling pull cord 20 and then slowly releases pull cord 20 so that the leg descends to the ground. The user can then repeat the routine with the other leg as seen in FIG. 11.

Figure 12:
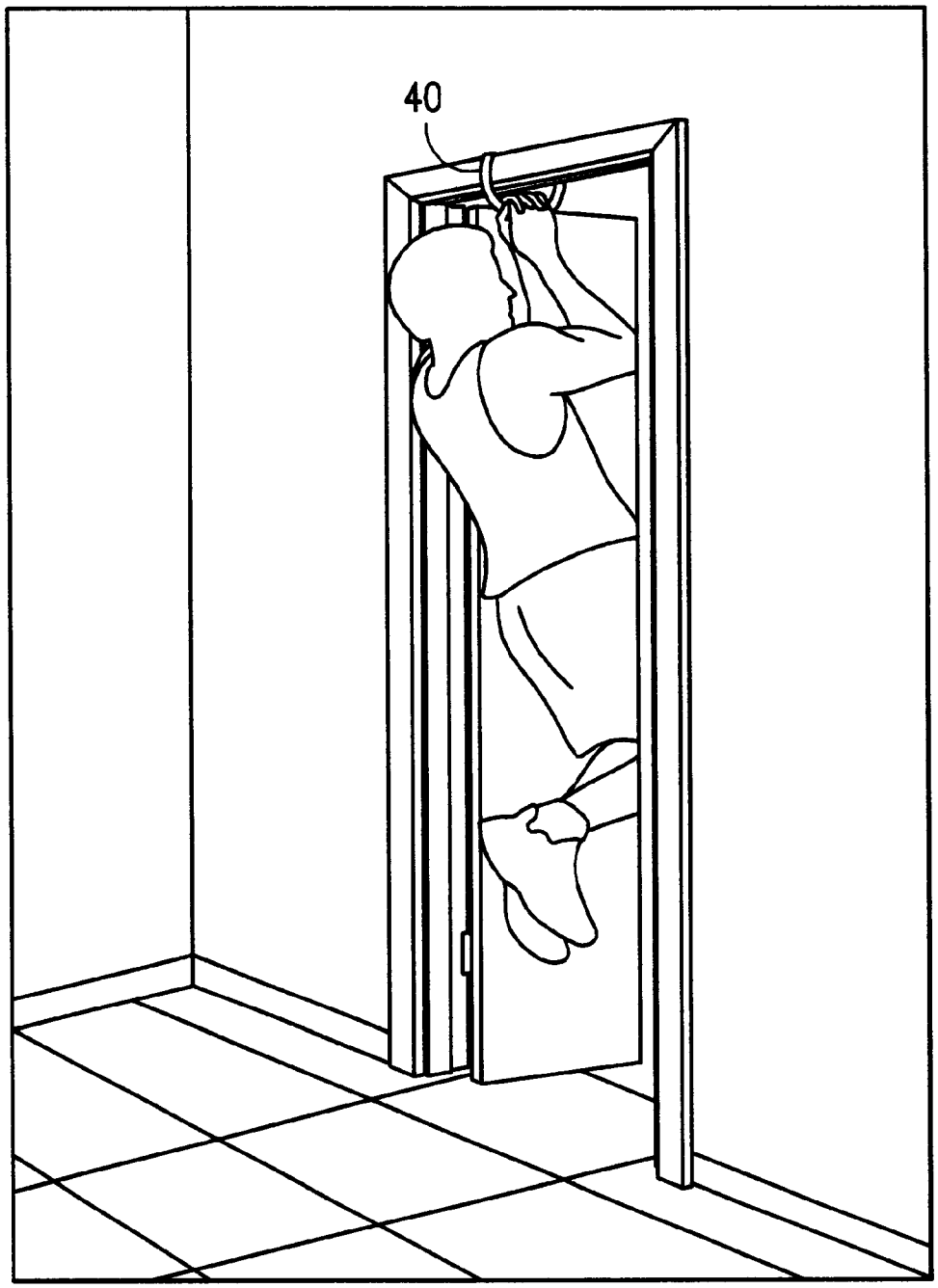
FIG. 12 is a perspective view of an alternative embodiment of the invention in use by a user performing a pull-up.

Referring to FIG. 12, there is seen attachment bracket 40 installed on a door frame and used for a two hand pull-up routine. The attachment bracket 40 may be used for pull-ups to exercise the biceps of the arms. A user simply grasps attachment bracket 40 and pulls themselves up causing the biceps to raise the weight of the users body. This common routine can be executed with only one hand grasping attachment bracket 40 or both hands grasping attachment bracket 40 depending upon the strength of the user. For safety reasons, it is preferred that the door frame and molding be able to easily support the user's weight. Alternatively, a second bracket 40 may be attached to the door frame, and a bar placed between the first and second brackets. The pull-up may then be performed on the bar.

Figure 14:
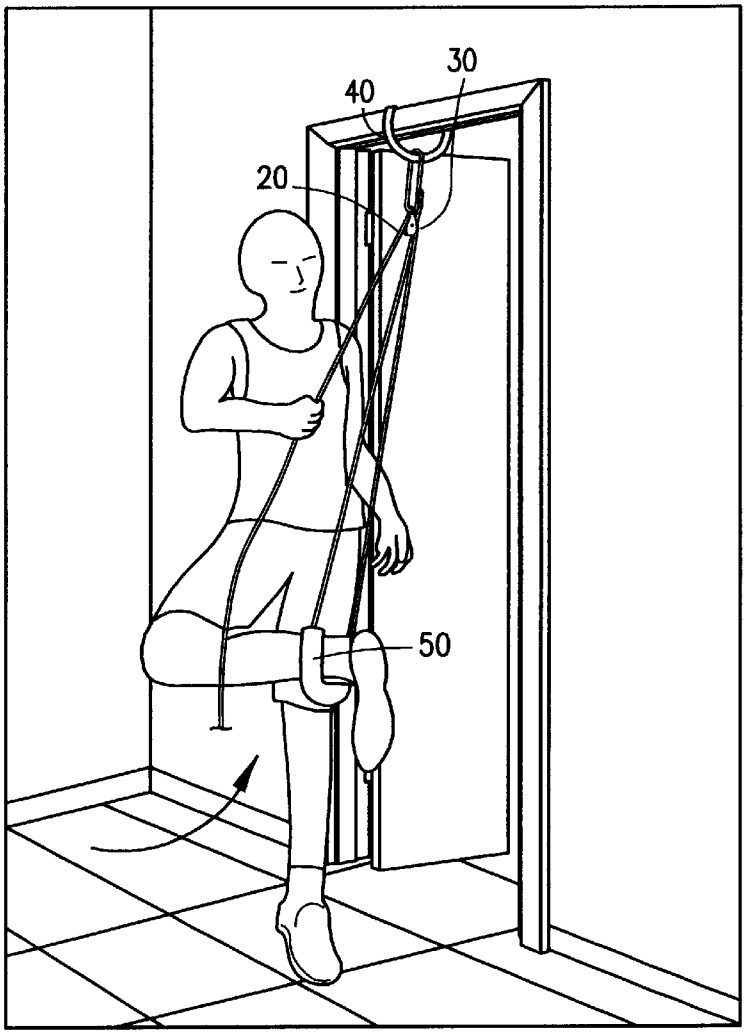
FIG. 14 is a perspective view of the invention in use as a user is performing a hip muscle stretch.
Figure 13:
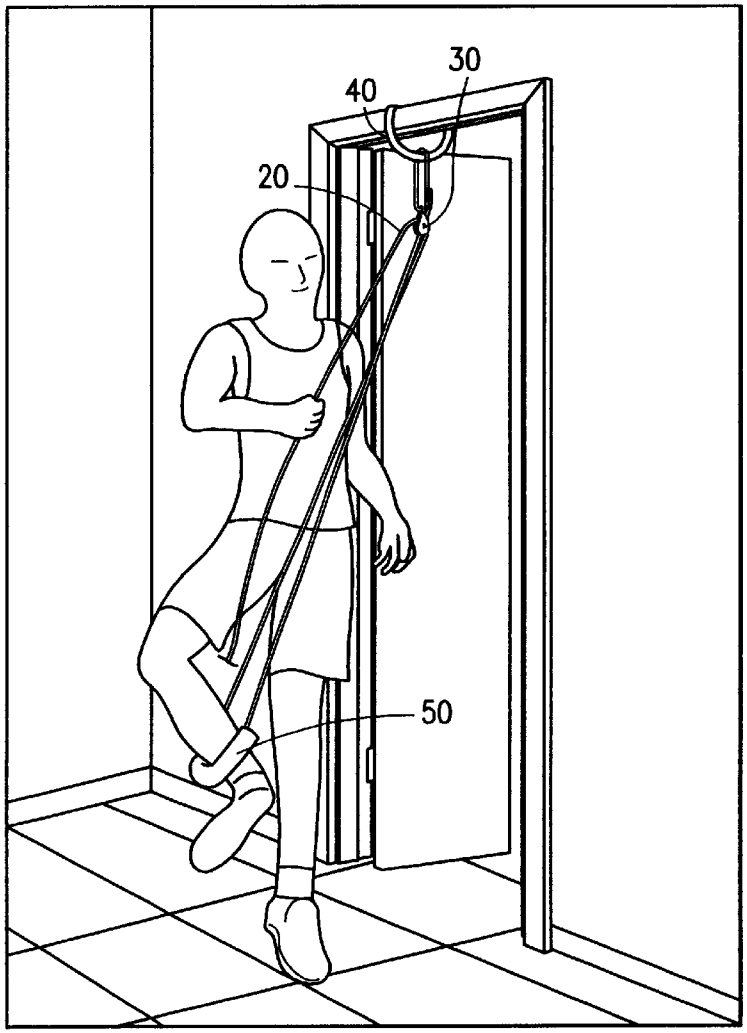
FIG. 13 is a perspective view of the invention in use as a user is in the initial stages of a hip muscle stretch.
Figure 16:
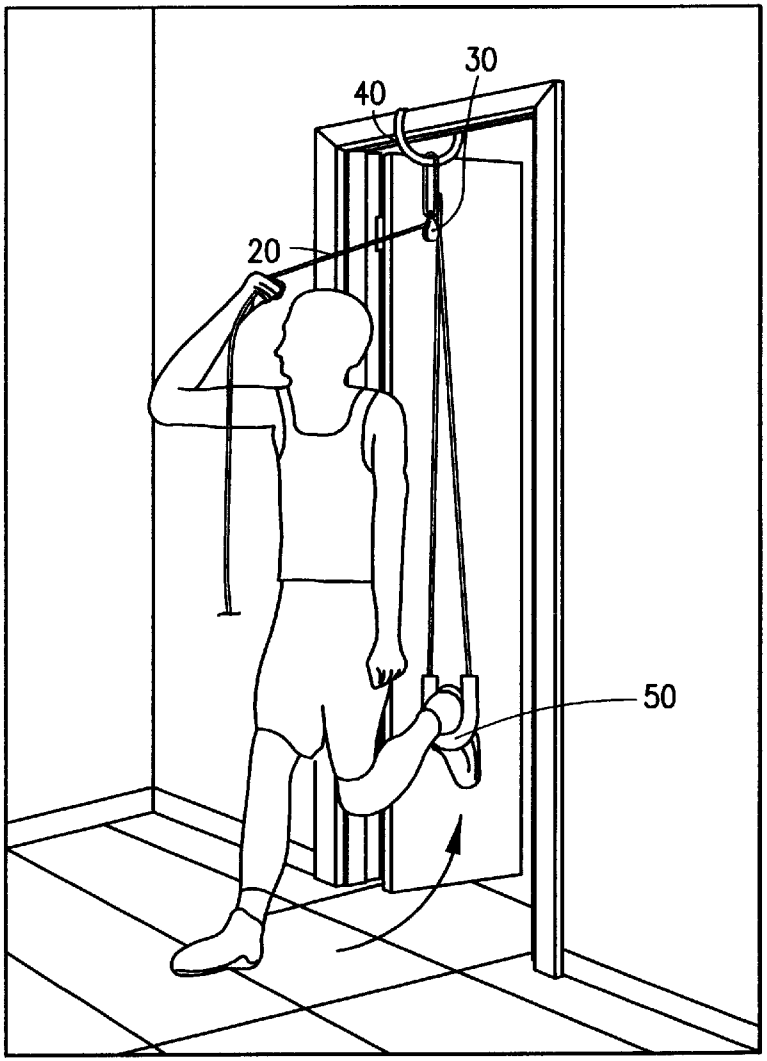
FIG. 16 is a perspective view of the invention in use as a user is performing a front thigh stretch.
Figure 15:
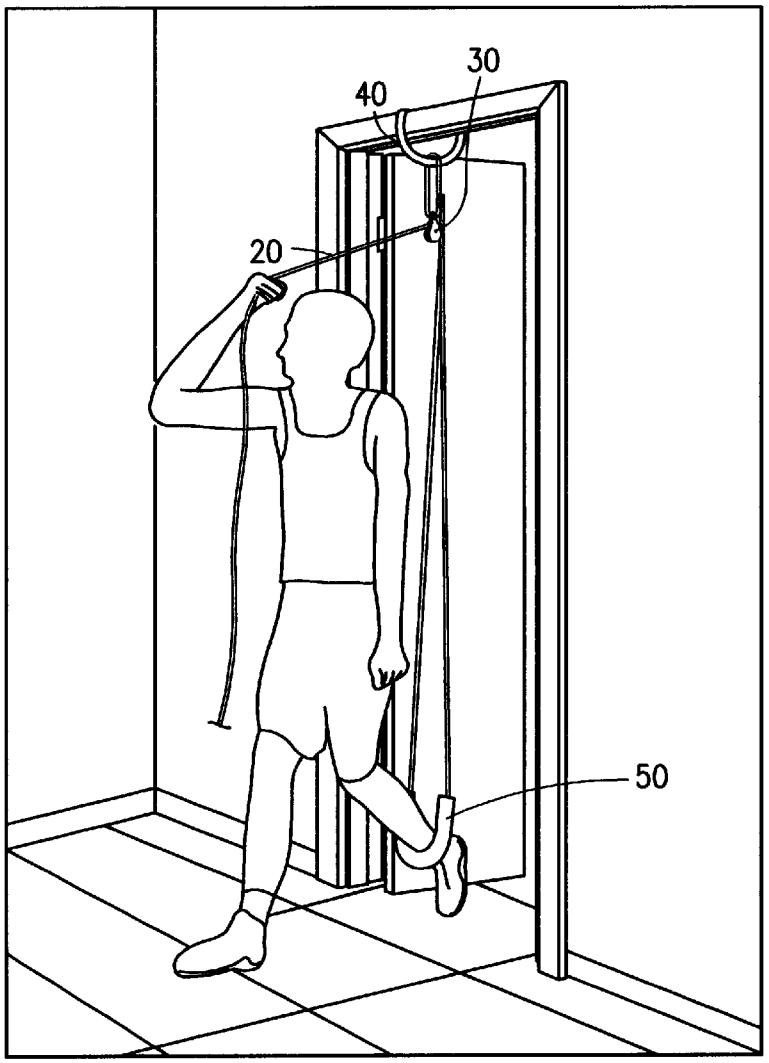
FIG. 15 is a perspective view of the invention in use as a user is in the initial stages of a front thigh stretch.
Figure 18:
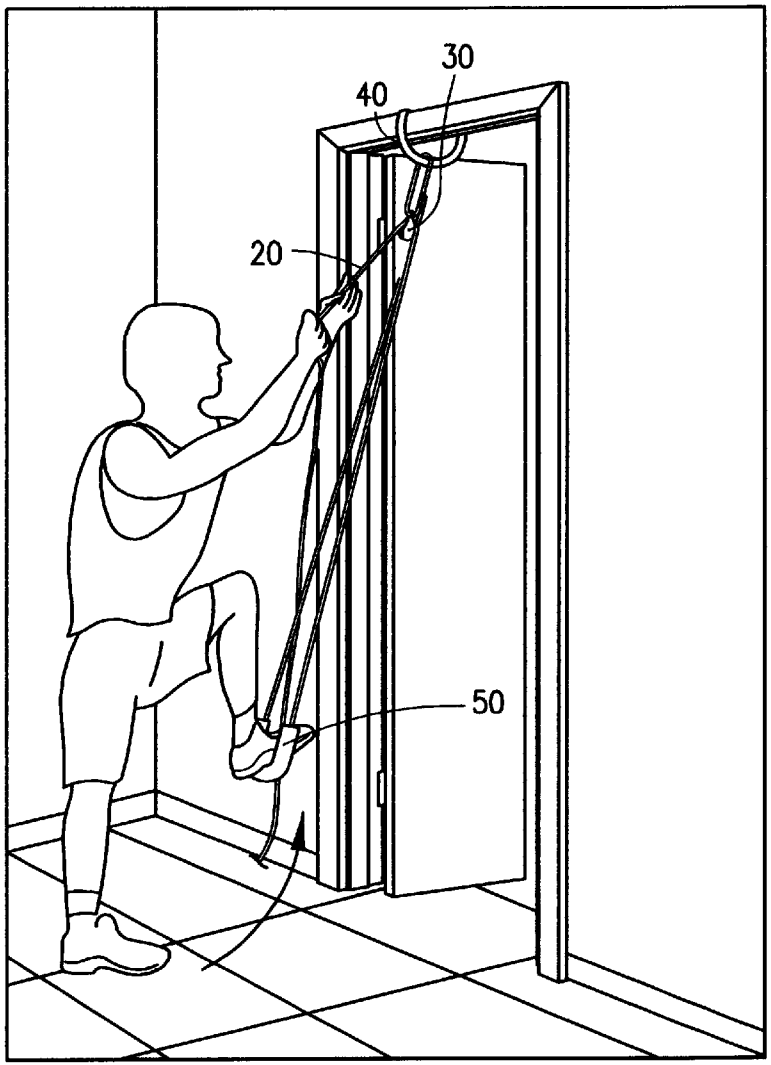
FIG. 18 is a perspective view of the invention in use as a user is performing a front and back upper thigh stretch
Figure 17:
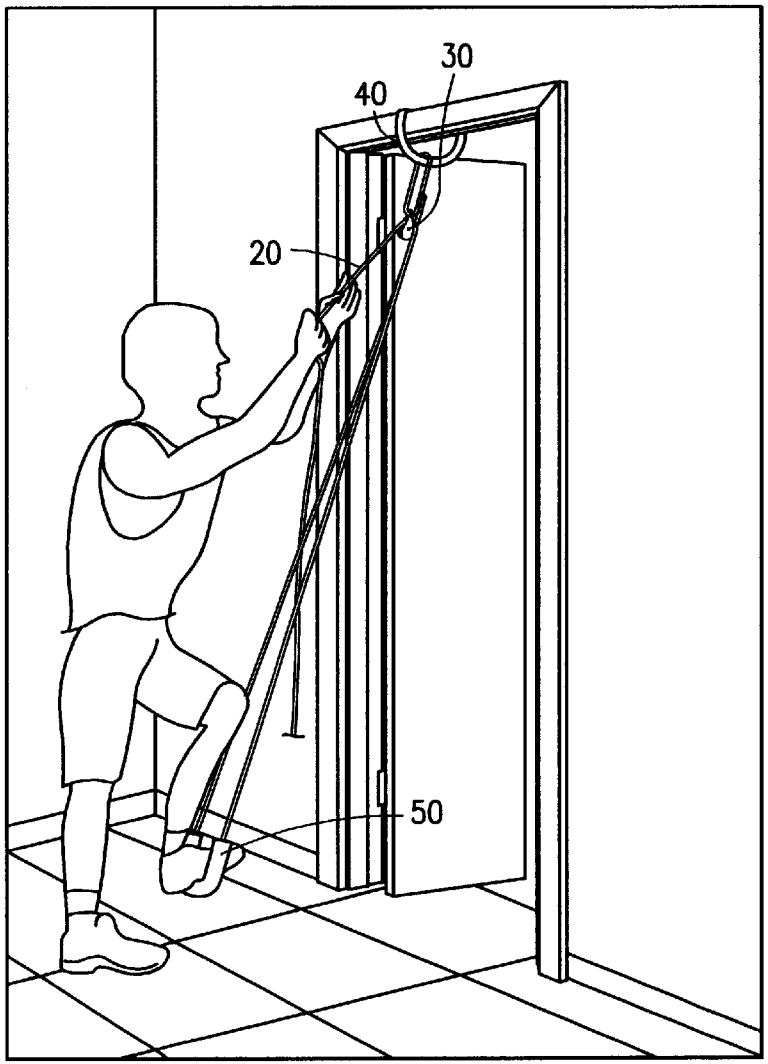
FIG. 17 is a perspective view of the invention in use as a user is in the initial stages of a front and back upper thigh stretch.

Referring to FIG. 13 and 14, a hip stretch may be performed as generally described for the previous stretches. Likewise, as shown in FIGS. 15 and 16, a front thigh stretch may also be performed. Moreover, a stretch isolating the front and back upper thighs may also be performed, as shown in FIGS. 17 and 18. Many other isolating stretches can also be made with the present invention.

In all of the stretches described herein, either the left leg or the right leg, or both, may be stretched. The use of the pulley 30 allows a person to easily lift the leg, diminishing the apparent weight of the leg. Thus a user may hold a stretch longer because the user does not expend as much energy lifting the leg.

It is preferred generally in lifting the leg in these stretches that the knee is slightly bent at the start, and then the leg is extended during the stretch. It is also preferred for greater control of the stretch that the user is leaning gently forward, or toward the device during use.

Accordingly, it is an object of the present invention to provide a stretching device that is easy to use, simple to assemble with few parts and easily transportable.

Yet another object of the present invention is to provide a stretching device which is inexpensive to produce and manufacture.

In accordance with these and other objects which will become apparent hereinafter, the instant invention will now be described with particular reference to the accompanying drawings.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A stretching device comprising:

a u-shaped attachment bracket having opposing ends, said attachment bracket having door frame attachment means for attaching to a doorframe;

a pull cord having opposing first and second ends, said first end having pull cord attachment means, said first end attached to said u-shaped attachment bracket by said pull cord attachment means;

a means for sliding adapted to receive said pull cord, said means for sliding attached to said u-shaped attachment bracket, said pull cord engaged with said means for sliding so that said pull cord forms a sling on one side of said means for sliding, said sling correspondingly raised and lowered by pulling or releasing said second end of said pull cord.

2. The stretching device of claim 1 wherein said means for sliding is a pulley.

3. The stretching device of claim 2 wherein said door frame attachment means are flat diametrically opposed fingers, said fingers formed integral with said attachment bracket, the plane created by said fingers perpendicular with the plane created by said u-shaped bracket.

4. The stretching device of claim 3 wherein said pull cord attachment means is a loop formed by the first end of said pull cord folded and attached to itself, said loop linked to said u-shaped attachment bracket.

5. The stretching device of claim 4 wherein said pulley is attached to said u-shaped attachment bracket by said loop.

6. The stretching device of claim 5 wherein said sling is padded by a padded sling support, said sling support including an inner tube which allows said pull cord to slide within and an outer padding.

7. The stretching device of claim 6 wherein said pull cord is formed by nylon rope.

8. The stretching device of claim 7 wherein said u-shaped attachment bracket is formed by electrical PVC pipe.

9. A stretching device comprising:

a u-shaped attachment bracket having flat diametrically opposed fingers at the opposing ends of said bracket, said fingers formed integral with said attachment bracket, the plane created by said fingers perpendicular with the plane created by said u-shaped bracket;

a pull cord having opposing first and second ends, said first end folded and attached to itself forming a loop linked to said u-shaped attachment bracket;

a pulley adapted to receive said pull cord, said pulley attached to said u-shaped attachment bracket by said loop, said pull cord engaged with said pulley so that said pull cord forms a sling on one side of said pulley, said sling correspondingly raised and lowered by pulling or releasing said second end of said pull cord.

* * * * *